US010566168B1

(12) United States Patent
Bennett

(10) Patent No.: US 10,566,168 B1
(45) Date of Patent: Feb. 18, 2020

(54) LOW VOLTAGE ELECTRON TRANSPARENT PELLICLE

(71) Applicant: John Bennett, Sammamish, WA (US)

(72) Inventor: John Bennett, Sammamish, WA (US)

( * ) Notice: Subject to any disclaimer, the term of this patent is extended or adjusted under 35 U.S.C. 154(b) by 0 days.

(21) Appl. No.: 16/100,680

(22) Filed: Aug. 10, 2018

(51) Int. Cl.
*H01J 19/40* (2006.01)

(52) U.S. Cl.
CPC ..... *H01J 19/40* (2013.01)

(58) Field of Classification Search
CPC ..... H01J 19/40; H01L 51/001
See application file for complete search history.

(56) References Cited

U.S. PATENT DOCUMENTS 1,788,553 A 1/1931 Thomas
2,197,042 A 4/1940 Gray
2,218,340 A 10/1940 Maurer
2,598,677 A 6/1952 Depp
2,754,428 A 7/1956 Franks
2,789,240 A 4/1957 Cohen
3,436,651 A 4/1969 Helms
4,106,937 A 8/1978 McTeague et al.
4,465,934 A * 8/1984 Westerberg ..... G03F 7/70716 250/398
4,771,168 A 9/1988 Gundersen et al.
5,057,740 A 10/1991 Kirkman-Amemiya
5,077,597 A 12/1991 Mishra
5,109,829 A 5/1992 Herden et al.
5,319,193 A 6/1994 Rogers et al.
5,430,305 A * 7/1995 Cole, Jr. ..... G01R 31/311 250/559.07
5,773,922 A 6/1998 Lee et al.
(Continued)

FOREIGN PATENT DOCUMENTS

EP 0476975 A1 3/1992
EP 3032568 A1 6/2016
(Continued)

OTHER PUBLICATIONS

"12 pulse bridge with thyristor valves.png," Wikimedia Commons, last edited Nov. 16, 2016 [retrieved Aug. 28, 2016], https://commons.wikimedia.org/wiki/File:12_pulse_bridge_with_thyristor_valves.png, three pages.
(Continued)

*Primary Examiner* — Douglas W Owens
*Assistant Examiner* — Syed M Kaiser
(74) *Attorney, Agent, or Firm* — Davis Wright Tremaine LLP

(57) ABSTRACT

One or more pellicles protect a cathode, the pellicles comprised of a thin layer of material that allows electrons to pass while preventing contamination of the cathode from elements originating beyond the pellicle or contamination of an outside apparatus from elements originating on or near the cathode. The pellicle can be supported by an insulator, the insulator in turn supported by a deflecting layer. The pellicle can be maintained at a positive voltage relative to the cathode, such that a voltage gradient is created between the cathode and the pellicle that accelerates electrons emitted by the cathode away from the cathode. The pellicle is located at an appropriate distance from the cathode to allow electron transmission matching the energy of the electrons at that distance.

19 Claims, 6 Drawing Sheets

(56) References Cited

U.S. PATENT DOCUMENTS

| | | | | |
|---|---|---|---|---|
| 5,793,152 | A * | 8/1998 | Tang | H01J 3/022 313/306 |
| 5,831,382 | A * | 11/1998 | Bilan | H01J 1/24 313/495 |
| 5,969,480 | A | 10/1999 | Schmolla et al. | |
| 6,220,914 | B1 | 4/2001 | Lee et al. | |
| 6,297,489 | B1 | 10/2001 | Suyama et al. | |
| 6,437,360 | B1 | 8/2002 | Cho et al. | |
| 6,512,385 | B1 * | 1/2003 | Pfaff | G01R 15/241 324/754.23 |
| 6,917,058 | B2 | 7/2005 | Niigaki et al. | |
| 7,646,149 | B2 | 1/2010 | Naaman et al. | |
| 7,816,866 | B2 | 10/2010 | Nakajima et al. | |
| 8,143,566 | B2 | 3/2012 | Levy | |
| 8,487,234 | B2 | 7/2013 | Levy | |
| 9,305,734 | B2 | 4/2016 | Jacquet et al. | |
| 2002/0113151 | A1 * | 8/2002 | Forber Jones | B01J 2/02 239/690 |
| 2003/0067312 | A1 * | 4/2003 | Pfaff | G01R 31/311 324/754.23 |
| 2004/0056279 | A1 | 3/2004 | Niigaki et al. | |
| 2005/0017648 | A1 | 1/2005 | Naaman et al. | |
| 2005/0018467 | A1 | 1/2005 | Naaman et al. | |
| 2006/0125368 | A1 | 6/2006 | Hwu et al. | |
| 2007/0096648 | A1 | 5/2007 | Nakajima et al. | |
| 2007/0188090 | A1 | 8/2007 | Kimiya et al. | |
| 2010/0290593 | A1 * | 11/2010 | Legagneux | H01J 35/065 378/122 |
| 2012/0181429 | A1 | 7/2012 | Levy | |
| 2013/0026917 | A1 * | 1/2013 | Walker | F03H 1/0075 315/85 |
| 2014/0113828 | A1 * | 4/2014 | Gilbert | G01R 33/0354 505/100 |
| 2014/0227548 | A1 * | 8/2014 | Myrick | C06B 45/30 428/570 |
| 2014/0367248 | A1 * | 12/2014 | Goldfarb | G03F 7/70983 204/263 |
| 2014/0370423 | A1 * | 12/2014 | Goldfarb | G03F 1/22 430/5 |
| 2015/0004722 | A1 * | 1/2015 | Yamazaki | H01L 51/001 438/14 |
| 2015/0287570 | A1 * | 10/2015 | Hayashi | H01J 37/222 250/310 |
| 2016/0133424 | A1 | 5/2016 | Chou et al. | |
| 2016/0163531 | A1 | 6/2016 | Hiruma et al. | |
| 2016/0322192 | A1 | 11/2016 | Hayashi et al. | |
| 2016/0359427 | A1 | 12/2016 | Ghosh et al. | |

FOREIGN PATENT DOCUMENTS

| | | | |
|---|---|---|---|
| RU | 2589722 | C1 | 7/2016 |
| SU | 1535257 | A1 | 7/1992 |
| WO | 2015175765 | A1 | 11/2015 |

OTHER PUBLICATIONS

"Desertec-Map large.jpg," Wikimedia Commons, last edited May 30, 2015 [retrieved Aug. 28, 2017], https://commons.wikimedia.org/wiki/File:DESERTEC-Map_large.jpg, four pages.

"FZ1200R45HL3 Technical Information," Infineon, product data sheet, Aug. 19, 2014, nine pages.

"High Voltage Direct Current Transmission—Proven Technology for Power Exchange," Siemens AG, Mar. 2007, Order No. E50001-U131-A92-V2-7600, 48 pages.

"How HVDC Works," Clean Line Energy Partners, copyright 2010-2017 [retrieved Aug. 28, 2017], http://www.cleanlineenergy.com/technology/hvdc/how, two pages.

"HVDC converter," Wikipedia, last edited Jul. 18, 2017 [retrieved Sep. 1, 2017], https://en.wikipedia.org/wiki/HVDC_converter, 13 pages.

"HVDC Inter-Island," Wikipedia, last edited Mar. 2, 2017 [retrieved Aug. 28, 2017], https://en.wikipedia.org/wiki/HVDC_Inter-Island, 12 pages.

"Insulated-gate bipolar transistor," Wikipedia, last edited Aug. 30, 2017 [retrieved Sep. 1, 2017], https://en.wikipedia.org/wiki/Insulated-gate_bipolar_transistor, four pages.

"Mercury Arc Valve, Radisson Converter Station, GillamMB.jpg," Wikimedia Commons, last edited Dec. 31, 2014 [retrieved Aug. 28, 2107], https://commons.wikimedia.org/wiki/File:Mercury_Arc_Valve,_Radisson_Converter_Station,_Gillam_MB.jpg, four pages.

"Pole 2 Thyristor Valve.jpg," Wikimedia Commons, last edited Nov. 27, 2016 [retrieved Aug. 28, 2017], https://commons.wikimedia.org/wiki/File:Pole_2_Thyristor_Valve.jpg, two pages.

"Transformation," Omexom Power & Grid, Jan. 2011, 1 page.

"Ultra High Voltage Direct Current system (UHV DC)," Siemens, copyright 2002-2017 [retrieved Aug. 28, 2017], https://www.energy.siemens.com/hq/en/power-transmission/hvdc/innovations/uhv-dc.htm#content=Description, four pages.

Bahrman, "HVDC Technology: Line Commutated Converters," 2014 IEEE/PES Transmission & Distribution Conference & Exposition, Apr. 15, 2014, 31 pages.

Canelhas, "High Voltage Direct Current (HVDC) Technology," Technical presentation—Alstom Grid, Sep. 22, 2010, 22.

Davies et al., "HVDC Plus—Basics and Principle of Operation," Special Edition for Cigré Exposition, Siemens Energy Sector, Aug. 10, 2008, 24 pages.

International Search Report and Written Opinion dated Mar. 29, 2018, International Patent Application No. PCT/US2017/067970, filed Dec. 21, 2017, 7 pages.

Johnson, "SiC/GaN Poised for Power," EE Times, Sep. 1, 2015 [retrieved Aug. 28, 2017], http://www.eetimes.com/document.asp?doc_id=1327577, three pages.

Kirby, "Panel Session: State of HVDC Technologies," US DOE Grid Tech: Applications for High-Voltage Direct Current Transmission Technologies, Apr. 22, 2013, 20 pages.

Sheng et al., "Reliability Enhancement of HVDC Transmission by Standardization of Thyristor Valves and Valve Testing," Sixth International Conference on Power T&D Technology, Nov. 10, 2007, 6 pages.

Siegmund et al., "Development of GaN photocathodes for UV detectors," Nuclear Instruments and Methods in Physics Research Section A: Accelerators, Spectrometers, Detectors and Associated Equipment 567(1):89-92, published online Jun. 13, 2006, print publication Nov. 1, 2006.

Zavahir et al., "Design Aspects of the Integration of the New Zealand HVDC Pole 3 Project," SCB4 Colloquium 2011, Oct. 2011, 14 pages.

Hasegawa et al., "Development of a Thyristor Valve for Next Generation 500KV HVDC Transmission Systems," IEEE Transactions on Power Delivery 11(4):1783-1788, Oct. 1996.

International Search Report and Written Opinion dated Oct. 31, 2019, International Patent Application No. PCT/US2019/045665, filed Aug. 8, 2019, 7 pages.

International Search Report and Written Opinion, dated Oct. 31, 2019, International Patent Application No. PCT/US2019/041361, filed Jul. 11, 2019, 7 pages.

Wikipedia, "Control grid," Dec. 22, 2018, retrieved Dec. 18, 2019 from https://en.wikipedia.org/w/index.php?title=Control_grid&oldid=874948349, 3 pages.

* cited by examiner

LOW VOLTAGE ELECTRON TRANSPARENT PELLICLE

BACKGROUND

Electron emitting cathodes, discovered in the 19th century, were the subject of Einstein's first Nobel Prize, and the basis of the vacuum tubes that created modern electronics. Although transistors have overtaken them in general electronics, many modern devices still use electron emitting cathodes. However, these cathodes would be more practical if they could endure long periods of operation in contaminating environments—electron lithography for example. Contamination remains an open problem because such environments can reduce the lifetime of cathode materials within hours, while the practical lifetime needs to be days or years. A need exists for an electron transparent pellicle, able to efficiently operate at lower voltages, that protects an electron emitter from contamination.

Figure 1:
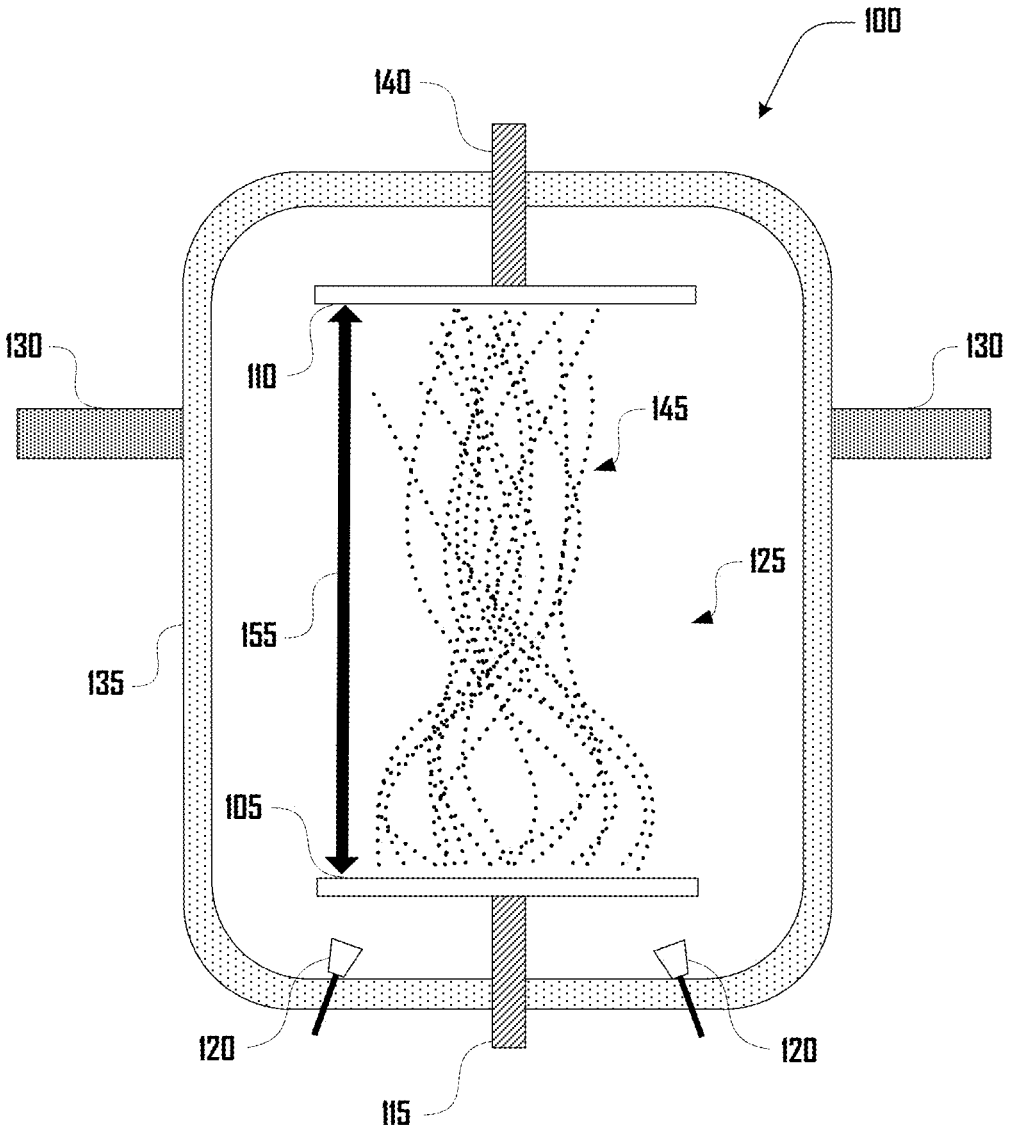
FIG. 1 is an exemplary diagram illustrating an embodiment of a rectifier.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Techniques described and suggested include methods and systems for protecting a cathode electron emitter from contamination. Example embodiments can be used with photo-cathodes (for example, a photo-cathode in a high-voltage switch), with dispensing cathodes, or with any other appropriate type of low-voltage, electron-emitting electrode. Although the examples and illustrations used throughout this specification describe a rectifier comprising a photo-cathode and anode enclosed in a vacuum, these examples are not intended to be limiting. Other variations are within the spirit of this disclosure. Throughout this specification, the terms "photo-cathode", "cathode", "emitting cathode", "electron-emitting cathode," and "electron emitter" shall be used interchangeably.

FIG. 1 is an exemplary diagram illustrating an embodiment of a photo-electric rectifier 100. An input electrical conductor 115 connects to a photo-cathode 105. The end of the electrical conductor 115 not connected to the photo-cathode 105 can be connected to an external electrical circuit (not shown). The photo-cathode 105 can be separated by vacuum 125 from a conductive anode 110, which in turn can be connected to the external electrical circuit (not shown) through a second output electrical conductor 140. The external electrical circuit (not shown) applies a voltage across photo-cathode 105 and anode 110, resulting in a flow of electrons 145. The photo-electric rectifier 100 can control the flow of electrons (electrical current) between the photo-cathode 105 and the anode 110.

In the example of FIG. 1, a photo-electric rectifier 100 possesses two electrodes, a photo-cathode 105 and an anode 110, separated by a gap 155 in a sealed vacuum tube. A photo-cathode 105 can be a negatively charged electrode that, due to the photoelectric effect, emits electrons when illuminated by a light source 120. Energy can be acquired from photons striking the surface of the photo-cathode and transferred to electrons within the material of the photo-cathode, causing the electrons to be ejected. When the photo-cathode is illuminated, electrons 145 can be emitted, flowing through the interior of the vacuum tube to the positively charged anode, resulting in a flow of current between the two electrodes. When the illumination 120 is switched off, emission of electrons stops, and the flow of current between the electrodes can cease.

High voltages in a photo-electric rectifier can introduce impurities or contaminants. For example, high-voltage electrons bombarding the surface of the anode 110 can create ionized atoms in the vacuum tube. The ionized atoms can then be attracted to the photo-cathode 105, leading to the deposit of contaminants on the photo-cathode.

Reducing the voltage required within the photo-electric rectifier can address contamination, but can also rob the electrons that are ejected from the photo-cathode of energy, slowing their exit from the region near the cathode and suppressing the rate at which new electrons leave the surface or its proximity. Low voltage gradients thus can reduce the rate of electrons that travel to the anode to generate current. Employment of a traditional control grid with a positive voltage relative to the photo-cathode, such as those used historically in vacuum tubes, can help accelerate electrons toward the anode, but in some examples, the relatively high positive voltage of a typical control grid can also draw in a significant percentage of those electrons, preventing such electrons from completing the circuit to the anode and reducing efficiency. A control grid can also prevent the device from operating at low voltage drops, which wastes energy in the main current times voltage between cathode and anode. To operate with a low voltage drop for efficiency, the grid must run at an even lower voltage.

In some examples, the surface of photo-cathode 105 can emit electrons when the energy per photon is greater than the electrical work function characteristic of the surface. The amount of this energy may not be exact because some electrons can have additional thermal energies or benefit from local variations in the surface. In various examples, photons possessing less energy than the nominal work function may not permit electrons to be released.

The electronic band structure (or simply band structure) of a solid can describe the range of energies that an electron within the solid may have (e.g., energy bands, allowed bands, or simply bands) and ranges of energy that it may not have (e.g., band gaps or forbidden bands). Band theory can derive these bands and band gaps by examining the allowed quantum mechanical wave functions for an electron in a large, periodic lattice of atoms or molecules. Band theory has been successfully used to explain many physical properties of solids, such as electrical resistivity and optical absorption, and can form the foundation of the understanding of all solid-state devices (transistors, solar cells, etc.).

In various examples, this formation of bands is a property of the electrons in the bonds and orbitals of the elements in the material. Band gaps are essentially leftover ranges of energy not covered by any band, a result of the finite widths of the energy bands and are forbidden to electrons because they do not match the structure and energy levels in the material. The bands can have different widths, with the widths depending upon the degree of overlap in the atomic orbitals from which they arise. In some examples, two adjacent bands may simply not be wide enough to fully cover the range of energy.

In some examples, the electronic band structure of solids, the band gap generally refers to the energy difference (e.g., in electron volts) between the top of the valence band and the bottom of the conduction band in insulators and semiconductors. The band gap can represent the energy required to promote a valence electron bound to an atom to become a conduction electron, which is then free to move within the crystal lattice and serve as a charge carrier to conduct electric current. For example, the bands associated with core orbitals (such as is electrons) can be extremely narrow due to the small overlap between adjacent atoms. As a result, there tend to be large band gaps between the core bands. Higher bands can involve comparatively larger orbitals with more overlap, becoming progressively wider at higher energies so that there are no band gaps at higher energies.

Thus, in various examples the band gap can be a factor determining the electrical conductivity of a solid. Substances with large band gaps are can be insulators, and substances with smaller band gaps can be semiconductors, while conductors in some examples either have either very small band gaps or even no band gaps because the valence and conduction bands overlap.

Various embodiments of the photo-electric rectifier 100 include light sources 120 capable of emitting light of a wavelength in which the photon energy is sufficient to stimulate electron emission from the photo-cathode 105. In one example embodiment, this light 120 can be provided by light emitting diodes (LEDs) with an optical path that leads the light to the photo-cathode 105. In another example embodiment, the light sources 120 can be lasers. In some examples, any appropriate source of photons can be used (e.g., A, B, C), subject to the requirement that the wavelength of the light include photons with energy greater than the work function of the electron photo-emission surface (the photo-cathode 105). In some example embodiments, the amount of light emitted by light sources 120 can be modulated in pulse frequency and/or intensity to best control the photo-electric rectifier 100.

In some example embodiments, light sources 120 can be located inside a vacuum tube, also known as a vacuum chamber 135, containing a vacuum 125, positioned either to shine directly on the surface of the photo-cathode 105 facing the anode 110 or to shine through the photo-cathode 105 from behind (as in the case of a transmission type photo-cathode, to be discussed later). In other example embodiments, reflective surfaces can be installed in the vacuum chamber 135 to create a path for photons such that they strike the surface of the photo-cathode 105 with optimal efficiency, no matter their position relative to the emissive photo-cathode 105 surface. In yet other example embodiments, the source of illumination 120 can be located outside the vacuum chamber 135 with the light being directed into the interior of the vacuum chamber 135 and the photo-cathode 105 through transparent or translucent vacuum chamber 135 walls.

Some embodiments of the rectifier 100 also allow for illumination by light at wavelengths with photon energy that is too low or at the wrong wavelength to initiate photo-emission. This light can be called "ineffective light," and can be used for purposes including, but not limited to, visual inspection of the rectifier 100 or generation of power for components of the rectifier 100 through the use of photo-cells.

In an embodiment, some of the most efficient and durable photo-cathodes 105 require ultraviolet light to cause electron emission. Consequently, light in the human-visible spectrum can be considered "ineffective" in various examples. Ineffective light can be present within the device or in the general vicinity of the device and surrounding equipment without causing electrons to be emitted from the photo-cathode 105.

As previously described herein, the light sources 120 can provide light of a wavelength such that the photon energy of the light exceeds the energy needed to cause the photo-cathode 105 to emit electrons through the photo-electric effect. The intensity of the light sources 120 can determine the number of electrons that can be emitted from the photo-cathode 105. If the light sources 120 are switched off, the photo-electric effect can be stopped and electrons can then cease to be emitted by the photo-cathode 105. The photo-electric rectifier 100 can be configured, in some embodiments, such that any ambient light striking the photo-cathode 105 (such as human-visible light shining into the photo-electric rectifier 100) will be of a wavelength associated with lower photon energy (ineffective light, as previously described) such that photo-emission will not be initiated.

The photo-cathode 105 and the anode 110 are shown in this example enclosed in a sealed vacuum chamber 135. The vacuum chamber 135 can be constructed of a durable, electrically insulating material, and sealed and evacuated such that it creates a high-quality vacuum 125. For the purposes of this specification, the terms "vacuum" and "high-quality" vacuum" shall be used to define a vacuum of a quality such that there are insufficient free-floating atoms or molecules within the vacuum chamber 135 to sustain an arc. An electric arc, or arc discharge, can be an electrical breakdown of a gas that produces an ongoing electrical discharge. Thus, when photons are unavailable from the light sources 120, the vacuum 125 can prevent current from flowing between the photo-cathode 105 and the anode 110 even if the voltage differential between the photo-cathode 105 and the anode 110 is very high. The material from which the vacuum chamber 135 is constructed can be a good electrical insulator, made from materials that will not readily decay, evaporate, or otherwise shed material that might contaminate the surfaces contained within the photo-electric rectifier 100 and create unwanted electrical conduction pathways. In various embodiments, it can be desirable for the interior surfaces of the vacuum chamber 135 to be free of contaminants during operation to prevent establishment of additional electrical conduction pathways.

The current flow in the rectifier can be modulated by the amount of light falling upon the photo-cathode. For example, in some embodiments, current flow is reduced to zero when light is removed from the photo-cathode 105. Photoemission from the cathode 105 can be a quantum process, allowing fast switching speeds in some embodiments, including but not limited to on the order of tens of picoseconds. The process of conversion from light to electrons can be almost perfectly linear, so some embodiments can be used to modulate power, as well as to switch it.

Some photo-cathode 105 materials can permit construction of a broad photo-cathode 105 surface that in some embodiments can supply several hundred amperes of current, given adequate illumination. In some embodiments, there can be a distance (vacuum gap 155) separating the photo-cathode 105 from the anode 110, allowing for voltage and electron flow to be blocked. For example, in some preferred embodiments, the distance separating the photo-cathode 105 from the anode 110 can be on the order of centimeters, e.g., 1, 5, 10, or 50 cm. In further embodiments, the voltage blocked by the vacuum gap 155 can be on the order of thousands of volts, e.g., 10,000, 50,000, or 150,000 volts. This can make it possible for some embodiments to rectify megawatts of power with a single rectifier 100. In some embodiments, upper power limits for a device are set by the ability to remove heat from the rectifier 100 and by the voltages that the external electrical loads may generate in opposition to fast switching. Although some embodiments described herein can include a vacuum gap 155 separating the photo-cathode 105 from the anode 110 on the order of centimeters, additional embodiments can include gaps on the order of millimeters, decimeters, or meters. Additionally, although some embodiments relate to high voltages blocked by a vacuum gap 155, further embodiments may block lower voltages, e.g., 100, 500, 1,000, or 5,000 volts.

The photo-cathode 105 can comprise various suitable materials. In some embodiments, the photo-cathode 105 can be constructed from a material capable of photo-emission, e.g., S1 (Ag—O—Cs), antimony-cesium (Sb—Cs), bialkali (Sb—Rb—Cs/Sb—K—Cs), high-temperature or low-noise bialkali (Na—K—Sb), multialkali (Na—K—Sb—Cs), gallium-arsenide (GaAs), indium-gallium-arsenide (InGaAs), cesium-telluride (Cs—Te), cesium-iodide (Cs—I), and gallium-nitride (Ga—N).

In an embodiment, a photo-cathode constructed of gallium-nitride with a trace layer of cesium can be used in conjunction with ultraviolet light (as a source of photons) possessing a wavelength shorter than 357 nm (more than 3.5 eV photon energy).

Photo-cathode 105 materials can be selected based on the desired performance characteristics of the photo-cathode 105, including but not limited to the desired spectral response, thermoelectric, and mechanical properties, and whether the photo-cathode 105 is a transmission type or a reflective type. Many different photo-cathode 105 materials exist and may be appropriate for use in the photo-cathode 105 of various embodiments. Some of these materials can be best adapted for front (reflective) illumination, while others can work best with rear (transmission) illumination.

In various examples of a transmission type photo-cathode, light strikes one surface or side of the photo-cathode 105 and electrons exit from the opposite surface or side. A transmission type photo-cathode 105 can be constructed by coating a transparent window with a photo-emissive coating that allows light to pass through, causing electrons to be ejected on the opposite surface from which the light is shone. For the purposes of discussion, the illuminated side of a transmission type photo-cathode shall be considered the "back side" of the photo-cathode 105, and the side from which electrons are emitted (that is, the side facing the anode 110) shall be considered the "front side."

A reflective type photo-cathode can be defined by a photo-cathode in which the light enters and the electrons exit from the same surface or side of the photo-cathode. In some embodiments, a reflective type photo-cathode 105 can be formed on an opaque metal electrode base. A variation on the reflective type photo-cathode 105 can include a double reflection type, where the metal base is mirror-like, causing light that passed through the photo-cathode 105 to be reflected back through the photo-cathode 105 to impart additional energy to the electrons in the base material. In some embodiments, a specialized coating that releases electrons more readily than the underlying material of the photo-cathode 105 base can be applied to the photo-cathode 105 to increase the photo-electric effect.

In various embodiments, the anode 110 operates at a positive voltage relative to the photo-cathode 105. The anode 110 can be any appropriate conductor or semiconductor material known to those in the arts capable of receiving current flow. In some embodiments, the anode 110 can be constructed from a material, e.g., tungsten, to improve the thermodynamic performance of the anode 110 (e.g., to absorb heat during rectifier shut-off).

Electrons emitted by the photo-cathode 105 can be attracted across the vacuum gap 155 to the positive voltage of the anode 110, creating current flow. In some embodiments, the anode can be narrower or wider than the cathode. In other embodiments, the anode 110 can comprise a copper plate oriented parallel to the photo-cathode 105. In other embodiments, a copper plate with a carbon or carbide alloy coating on the surfaces where electrons arrive can be used. In some embodiments, a carbon or carbide alloy coating on the anode 110 can result in a low rate of sputtering or ion emission under electron impact.

In another embodiment, the anode 110 can be constructed of tungsten, allowing the device to absorb high energy pulses during switching events or operate with a high voltage gradient between the photo-cathode 105 and anode 110. In another example embodiment, the anode 110 itself can comprise a photo-cathode 105, such that the device can operate to conduct current in either direction, allowing bi-directional current flow.

The photo-electric rectifier 100 can be installed in an electrical circuit such that it is surrounded by a collar of insulating material 130, to avoid current bypassing the device. This electrical isolation can also be achieved by placing the photo-electric rectifier 100 in a vacuum. The photo-electric rectifier 100 should also be installed so as to avoid establishing electrically conductive pathways with external surfaces and surrounding equipment.

In various examples, when a high vacuum 125 is established within the photo-electric rectifier 100, and all surfaces are properly insulated or isolated, electricity can flow only when the light sources 120 are energized and cause electrons to be emitted from the photo-cathode 105 through the photo-electric effect. In some embodiments, the current can only flow in one direction, when the photo-cathode 105 potential is sufficiently negative relative to the anode 110. The amount of current flowing through the device can depend upon the quantity of electrons produced by the photo-cathode 105, and can therefore be modulated by the intensity of the light sources 120.

Figure 2:
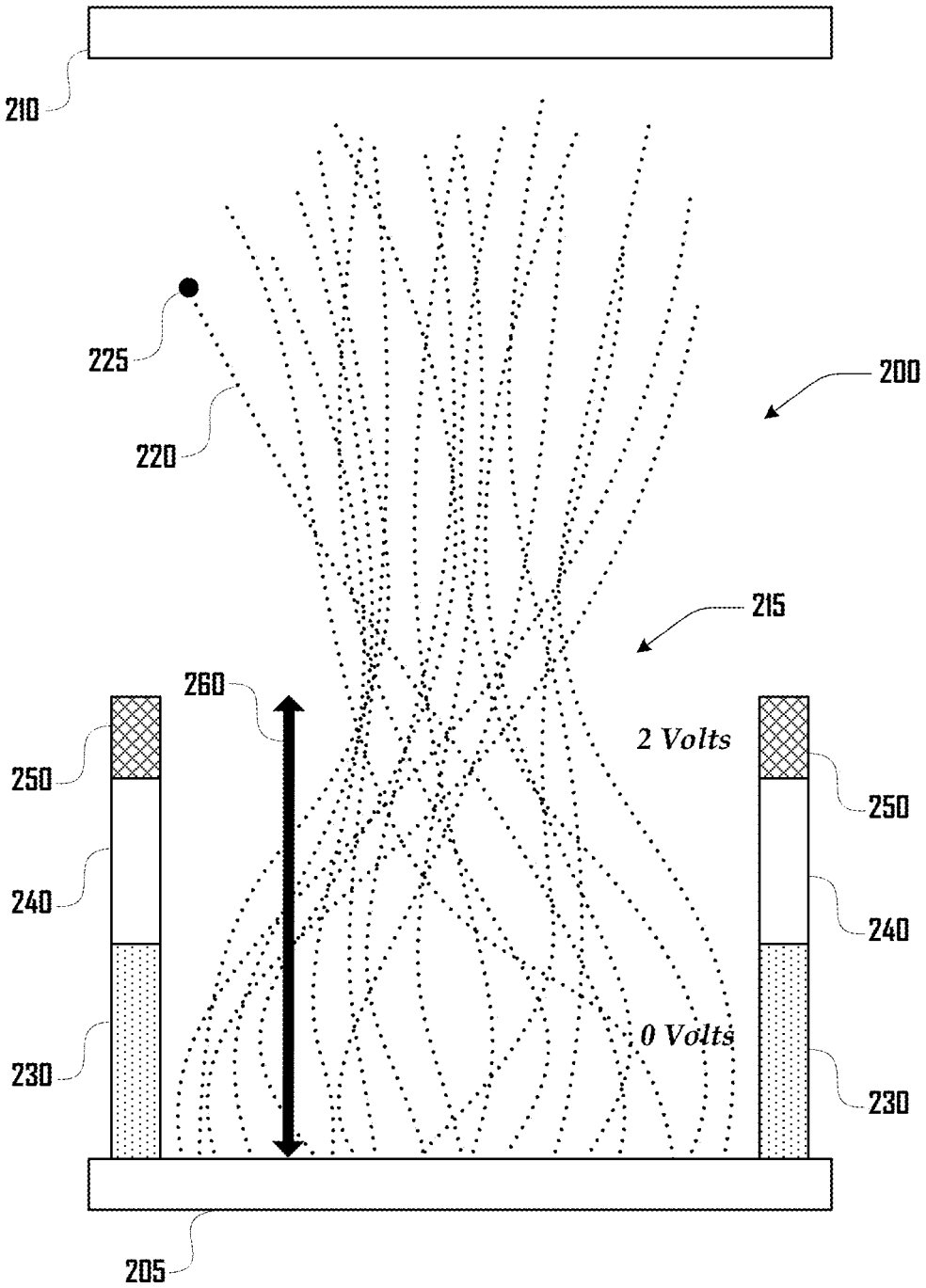
FIG. 2 is an exemplary diagram illustrating how electrons emitted from a cathode travel toward an anode.

FIG. 2 is an exemplary diagram illustrating the flow of electrons 200 from a cathode 205 to an anode 210, showing electron flow in the presence of a cathode control grid 215. Here, the paths of emitted electrons 220 can be shaped by the voltage gradient of a control grid 215. In an embodiment, as electrons 225 are produced by the photo-cathode 205, they can be deflected toward the middle of the control grid 215 by voltage on deflection zone 230 (here, equivalent to that of the photo-cathode 205). In an example, photo-cathode 205 is in direct contact with the deflection zone 230 and both are held at 0 volts. It should be noted that voltages used in the examples in this specification are exemplary and not intended to be limiting in any way, and that voltages may be relative values as compared to other components in the system and not necessarily absolute voltage values. The deflection zone 230 can be electrically separated from the grid zone 250 by insulation zone 240. The electrons 220 can then enter an intense voltage gradient 260 formed by the walls of the control grid 215, the deflection zone 230, the insulating zone 240, and the grid zone 250. As illustrated by the flow of electrons 200, as the electrons 220 can be deflected toward the center of the control grid 215 by the deflection zone 230, they can be far enough away from the grid zone 250 when they are pushed out of the control grid 215 by the potential gradient 260, preventing them from being attracted to the grid zone 250. The electrons 220 can then travel toward distant anode 210.

In the example of FIG. 2, the grid zone 250 can be held at a voltage of 2 volts relative to the photo-cathode 205, and thus an intense voltage gradient 260 can be created between the top of the deflection zone 230 and the grid zone 250. Although the voltage at the grid zone 250 can be relatively low (in this example, 2 volts), the height of the grid walls can be in the order of microns (for example, 100 microns or less). This ratio of voltage to distance can create a very intense voltage potential gradient 260, which can be on the order of tens of thousands of volts per meter. Consequently, this intense gradient can push electrons 220 out of the grid cell 215 quickly, allowing new, replacement electrons to be emitted by the photo-cathode 205, creating a strong current flow using a relatively low voltage. In an embodiment, such a low voltage may be 100 volts or less.

Although the positive voltage of the grid zone 250 relative to the photo-cathode 205 can attract electrons 220, interrupting their travel toward anode 210, the electron paths 220 created by the arrangement of deflection zone 230, insulating zone 240, and grid zone 250 and the corresponding intense potential gradient 260 can cause the majority of electrons 220 to be deflected toward the center of the grid cell 215 and pushed past the grid zone 250 toward the distant anode 210, preventing capture by the grid zone 250. The ratio of the zones 230-250, the height of the grid walls, the width of grid cell 215, and the voltage levels applied can be adjusted as appropriate to shape electron paths 220 in an attempt to optimize the flow of electrons 220 between cathode 205 and anode 210.

FIG. 2 is not drawn to scale, and is intended to demonstrate concepts only. For the purpose of clarity, the cathode 210, anode 220, and control grid 215 are shown without a surrounding structure, such as the vacuum chamber 135 or enclosed vacuum 125 of FIG. 1.

One embodiment places an electron-transparent pellicle on top of a rigid support structure that in turn stands on the surface of the photo-cathode. This support structure may be sized and configured to be compatible with the strength and characteristics of the monolayer material. The distance from the cathode to the pellicle may range from direct contact to a millimeter or more. If the pellicle is separated from the cathode, various embodiments can allow a steep electric potential to be established at the pellicle near the surface of the photocathode. This can accelerate the electrons away from the cathode, permitting high current operation at with low voltages and power dissipation. The voltage can also so low as to reduce the probability of ionizing contaminants forming anion contamination.

Figure 3:
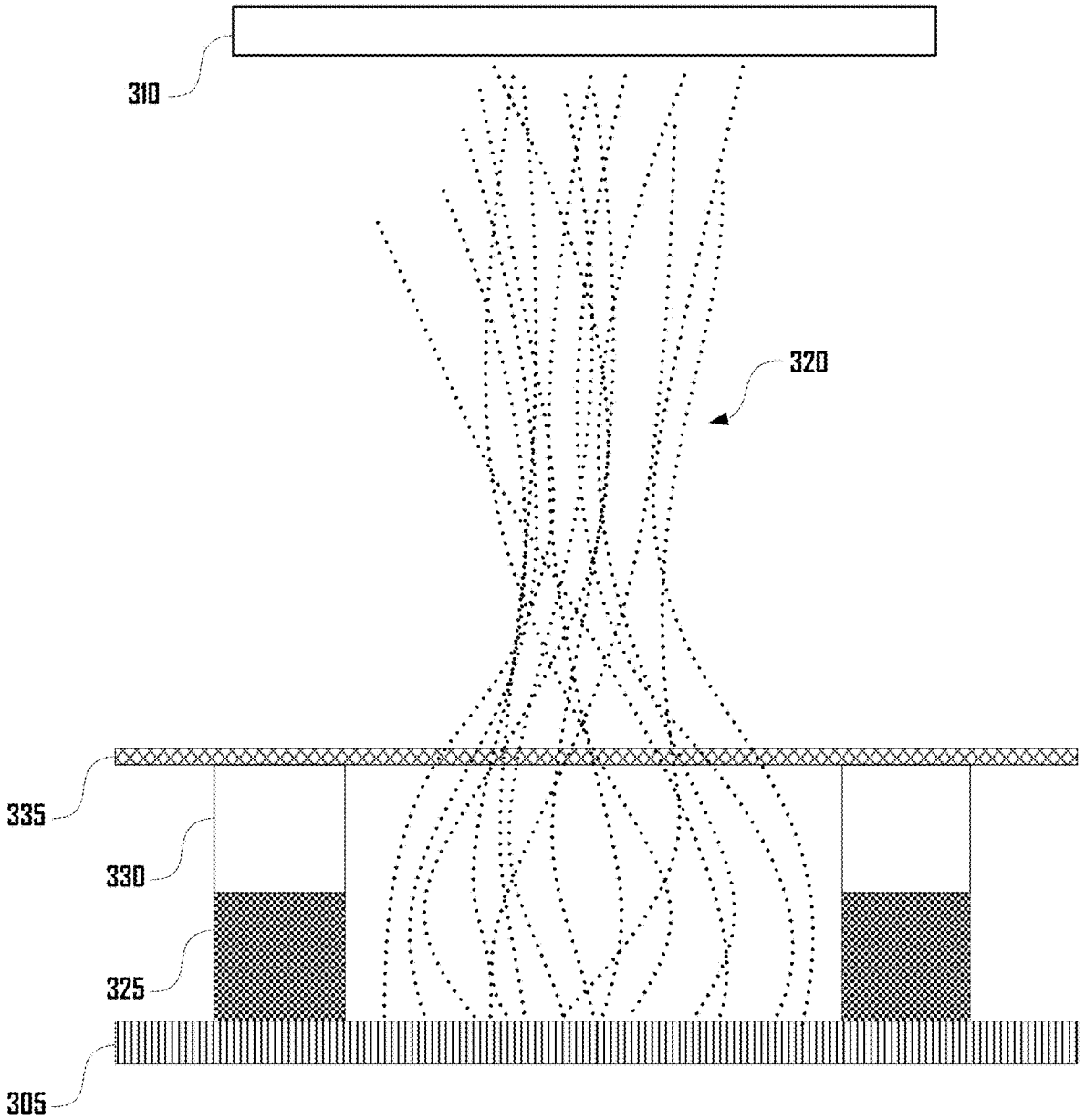
FIG. 3 is an exemplary diagram of an embodiment of an electron source with a single pellicle.

FIG. 3 is an exemplary diagram illustrating a cross-sectional view of an electron emitting cell with a pellicle covering. The cathode 305 can be a source of electrons 320. Voltages on the support walls 325 and 330, and pellicle 335 can move electrons away from the surface. Most electrons can pass through the pellicle if the voltage of the pellicle relative to the voltage of the cathode is within one of the electron transparency energy ranges ("windows") of the pellicle material. In an embodiment, the pellicle can be supported by a structure 325 and 330 using conducting, weakly conducting, or insulating materials to obtain the desired voltage gradients to control the electron trajectories. The pellicle can be physically and electrically separated from the cathode. The device can be operated in vacuum or low pressure and the region between the pellicle and the cathode can be free of substances that could contaminate the cathode.

Insulators can possess a valence band that is fully occupied with electrons due to sharing outermost orbit electrons with neighboring atoms. Furthermore, the conduction band can be empty, i.e., no electrons are present in the conduction band. Additionally, the forbidden gap between the valence band and conduction band can be very large in insulators. In some examples, the energy gap of an insulator can be approximately 15 electron volts (eV). An insulator can have all its electrons bound and can provide no mobility even for electrons raised to high energy. The material can disallow free electrons since no mobile orbitals exist.

Conversely, a conductor can have free mobile electrons in outer orbitals at arbitrary energies. The valence band and conduction band may overlap in a conductor. Consequently, a conductor may not possess a forbidden gap and a small amount of applied external energy can provide enough energy for valence band electrons to migrate to the conduction band. As valence band electrons move to the conduction band they can become free electrons that are unattached to the nucleus of a particular atom. Conductors can possess a large number of electrons in the conduction band at room temperature, i.e., the conduction band is saturated with electrons, while the valence band is only partially filled with electrons. Those electrons in the conduction band may move freely and conduct electric current from one point to other.

In contrast to both insulators and conductors, semiconductors can have orbitals containing mobile electrons. However, those electrons exist at levels that can be above the base orbitals, and so are only available in various examples if the electrons are boosted to that higher level. A forbidden band can exist between the bound orbitals and the mobile orbitals, which typically vary from about 1 to 5 eV for various semiconductors. Semiconductors can have a very small forbidden gap between the valence band and conduction band. At low temperatures, the valence band of a semiconductor can be completely occupied with electrons and the conduction band can be empty because the electrons in the valence band have insufficient energy to migrate to the conduction band. Consequently, at low temperatures, a semiconductor can behave as an insulator.

However, at room temperature some of the electrons in the valence band can gain sufficient energy in the form of heat to move to the conduction band. As the temperature is raised, additional valence band electrons move to the conduction band. This demonstrates that the electrical conductivity of a semiconductor can increase with temperature, i.e., a semiconductor can have a negative temperature co-efficient of resistance.

One embodiment includes a cathode 305 capable of emitting electrons into vacuum in which the cathode 305 can be covered by one or more pellicles 335 formed from very thin films such as layers of graphene or other 2-dimensional materials. This pellicle 335 can be held at a small positive voltage relative to the cathode 305 but can also be physically close to the cathode 305. In an embodiment, the voltage at the cathode may be 100 volts or less. In further embodiments, the voltage at the cathode can be equal to or less than 200 volts, 175 volts, 150 volts, 125 volts, 100 volts, 75 volts, 50 volts, 25 volts, or the like. While employing a low voltage differential, the ratio of small voltage over small distance can create an intense potential gradient that can attract electrons away from the cathode and toward the pellicle 335. The atomic structure of each pellicle can be chosen such that most electrons will pass through the pellicle 335. In some embodiments, electrons having specific energies matching a forbidden range of the pellicle 335 in which the electrons cannot be absorbed may transit through the pellicle 335 as if it were transparent. Different energy windows may be obtained, in some examples, using pellicles of different materials or with a different number of layers. Some embodiments employ a sequence of pellicles, each possessing a different voltage that matches their transparency. Pellicles can also be constructed from single layer materials having a porous structure that allows electrons to pass through the pores, but with the pores being too small to allow atoms or molecules to pass through the pores. For example, a dual layer of graphene can create a pellicle with a transmission window at voltages matching a forbidden quantum level characteristic of that bilayer, while a 3-layer graphene pellicle can possess two energy ranges at which electrons can pass efficiently.

In various examples, such energy windows would also be expected to exist in films using one or more layers of other two dimensional materials, such as hexagonal boron nitride or molybdenum sulfide, with added dopants to modify the electrical properties. Various embodiments can rely on quantum effects creating energy bands unable to absorb the electrons because of the existence of forbidden electron energy bands in the material. Different pellicle materials can offer advantages of different voltages for transmission, and different chemical or mechanical properties can be useful to the overall apparatus.

The pellicle 335 can be a physical barrier to atoms and molecules and thus can protect the cathode 305 from contamination even while allowing electrons 320 to pass. A cathode thus covered can be protected from contaminants originating beyond the pellicle. As some photocathodes can be susceptible to contamination, preventing contamination can substantially increase the operational life and utility of photocathodes in some embodiments.

Figure 4:
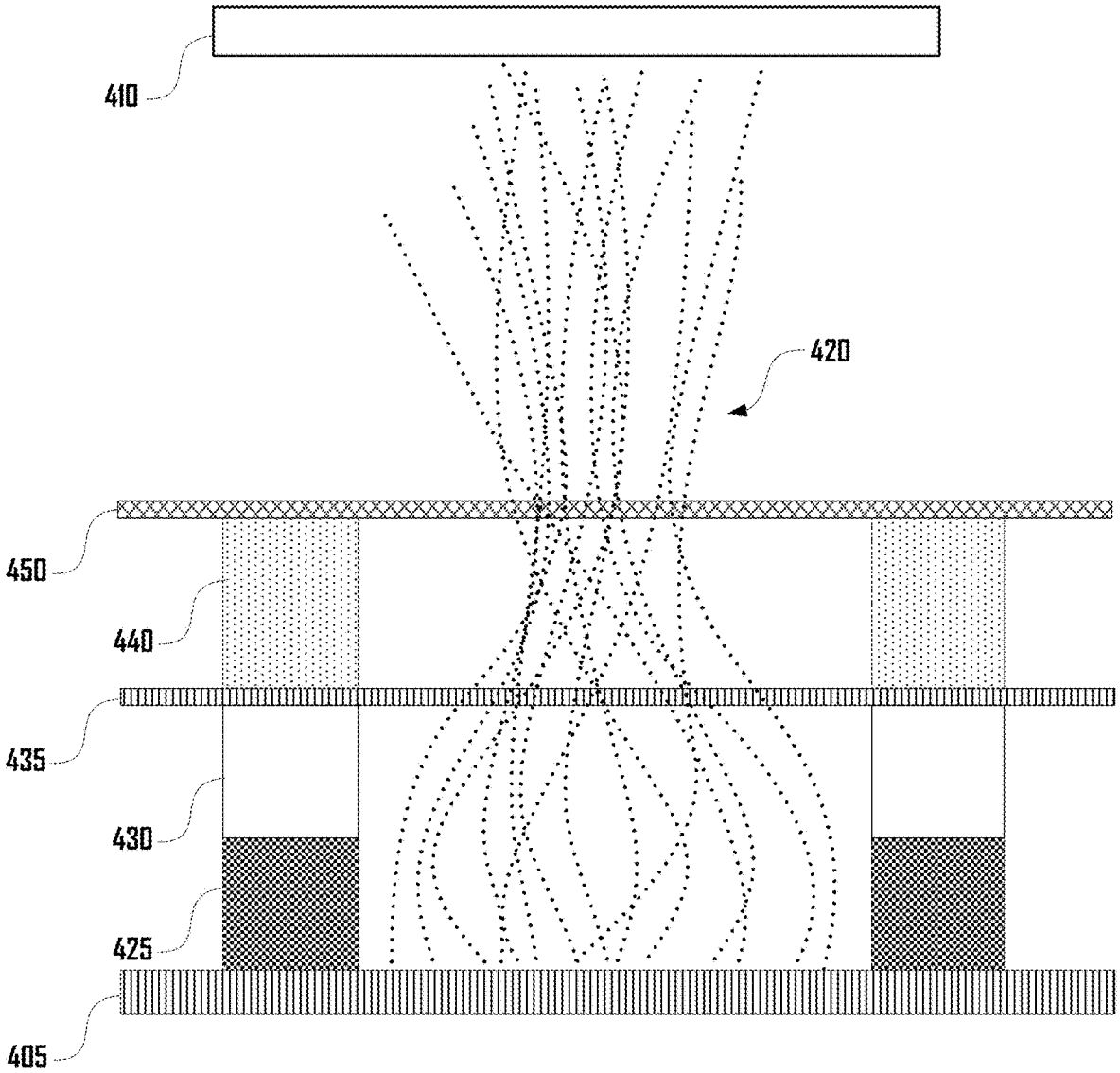
FIG. 4 is an exemplary diagram of an embodiment of an electron source with multiple pellicles.

FIG. 4 is an exemplary diagram illustrating a cross-sectional view of an electron emitting cell with multiple pellicles 435 and 450. The cathode 405 can be a source of electrons 420. Most electrons can pass through both pellicles 435 and 450 if the voltages are chosen such that the electrons possess energy matching one of the available transparency energy ranges of each pellicle. In an embodiment, this can be accomplished by selecting the pellicles 435 and 450 to offer a sequence of ranges and setting the voltage on each pellicle to provide the corresponding electron energy. In an embodiment, the pellicle 435 can be supported by a structure comprising a deflecting layer 425 and an insulating layer 430, and topped by a second insulating layer 440 and a second pellicle 450 using materials that are conducting, weakly conducting, or insulating, to obtain the desired voltage gradients for controlling electron trajectories. Multiple pellicles and insulating layers can be employed. The pellicles 435 and 450 can be physically and electrically separated from the cathode 405 and from each other. In an embodiment, the device will be operated in vacuum or low pressure and the region between the pellicles 435 and 450 and the cathode 405 will be kept free of substances that could contaminate the cathode 405.

The one or more pellicles may be parts in a system that includes other electrodes designed to shape and control the paths of electrons that are emitted from the cathode. The cathode may be a thermo-electric, photo-electric, or other form of electron emitter. The cathode may be modulated to adjust the numbers of electrons emitted. The cathode can be in a vacuum or very low pressure chamber free of harmful contaminants and be substantially isolated from the environment on the other side of the pellicle.

Figure 5:
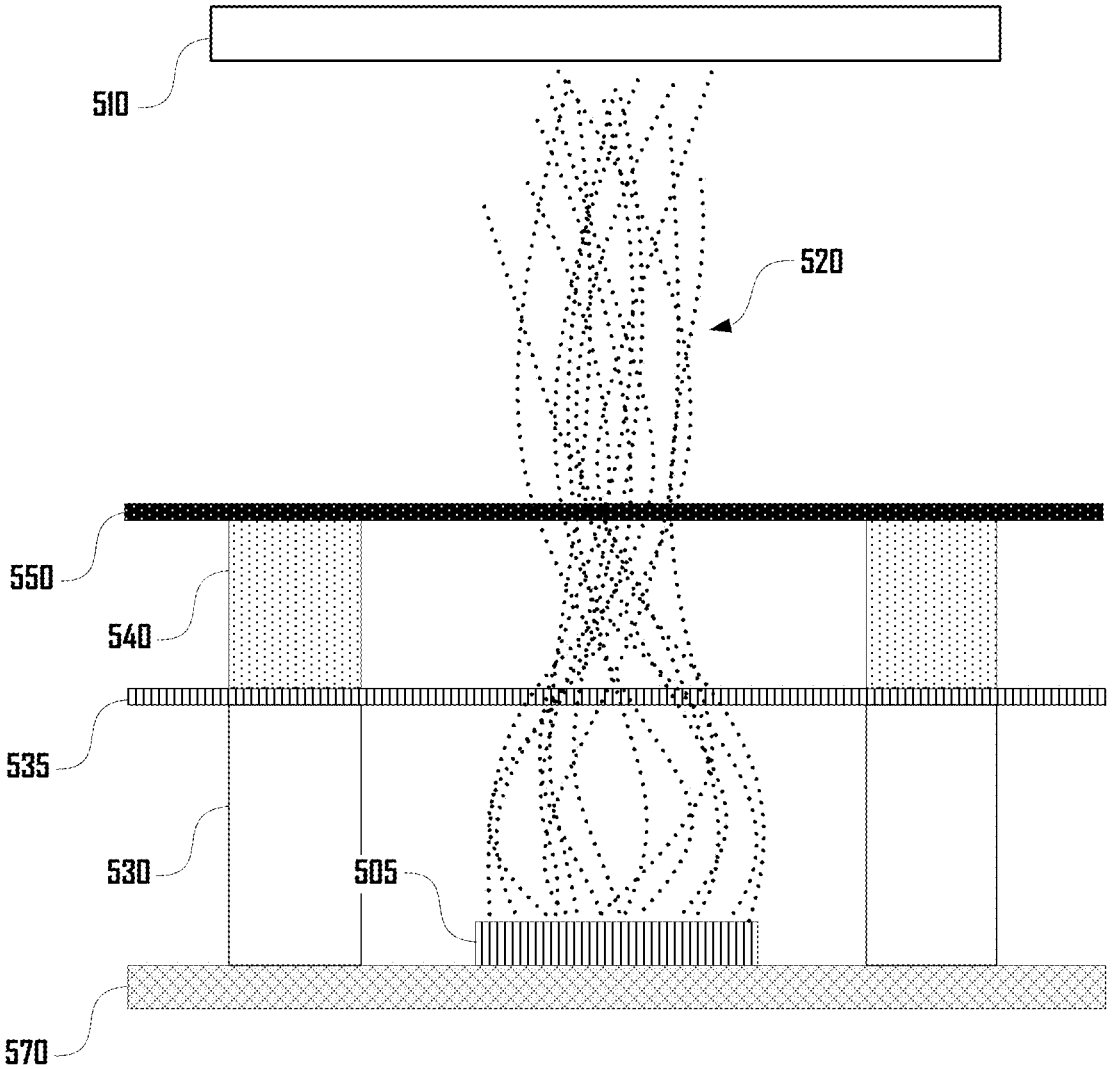
FIG. 5 is an exemplary diagram illustrating an embodiment of surface-mounted electron dispenser with multiple pellicles.

FIG. 5 is an exemplary diagram illustrating a cross-sectional view of an electron dispenser with multiple pellicle coverings. Electron sources such as current dispensers 505 can be sources of contaminants that evaporate off the cathode surface. In an embodiment, the current source material, such as barium, can degrade and prevent proper operation of the rest of the device. In an embodiment, a cathode/dispenser 505 can be placed on a hot, conductive supporting surface 570 surrounded by the support 530 and covered by a pellicle 535, so that any contaminants are contained. The pellicle can remain clean through chemical passivity where the pellicle and supports do not combine with the contaminant allowing it to evaporate preferentially back to the cathode. This evaporation can be promoted by running a current through the pellicles 535 and 550, and supports 530 and 540 that, through electrical resistance, keeps them hotter than the emitter 505. In an embodiment, there may be additional pellicles that refine the shaping and modulation of the electron paths 520.

In some embodiments, barium (Ba) dispensers can be troublesome due to evaporation. Enclosing such dispensers behind a pellicle in some embodiments, avoiding loss of material through evaporation, can create a stable and clean electron sources with a longer useful lifetime. The volatility can be further reduced, in other embodiments, by cooling a dispenser, and promoting the return of material from the pellicle to the cathode by keeping the pellicle hotter than the photocathode (or keeping the photocathode cooler than the pellicle).

Some embodiments can isolate the source of the electrons from the vacuum and working environment and allow low energy electrons to pass. Monolayer films can allow a useful fraction of low energy electrons to pass in some embodiments. Some multilayer films provide transparency to electrons in energy ranges where the film structure forbids electron capture. Thus, one or more pellicles may be created from single or multiple layers of graphene or similar 2-D materials that block physical contamination while passing low voltage electrons.

Electrons can tunnel through barriers by quantum effects. Consequently, when an electron reaches a thin film of a thickness of an angstrom or two, e.g., graphene, the probability function can allow the electron to either bounce off the film, be absorbed, or tunnel through. In some examples, if the film is constructed of an insulator like hexagonal boron nitride (h-BN), electrons cannot be absorbed since the forbidden layer precludes added electrons (in various examples, one could add enough energy to kick an electron out completely and allow the new arrival, but the required energy would be more than 5 eV). The alternatives to absorption can be reflection or transmission. The thinness of the layer and hexagonal pores can favor transmission. In an embodiment, a pellicle constructed of a semiconductor like dual-layer graphene can possess a forbidden band, e.g., 3 eV, eliminating the possibility of absorption and increasing transmission for electrons with energy in the forbidden range. A pellicle constructed of triple layer graphene can possess two forbidden bands.

Transparency windows can occur in low energy ranges, generally less than 5 eV. In some embodiments, these voltages are less than the binding energies in the pellicle materials so electrons at these energies will not damage the pellicle unless the current flow is so high as to create extreme temperatures. In an embodiment, the electrons that pass through the pellicle can be directed to other parts of the apparatus, e.g., they can enter an electron lens that may raise their voltage, focus, or otherwise change the electron paths.

Some embodiments can be constructed at a micron scale in which even small voltage differences can create the steep potential gradients that quickly clear electrons away from the cathode, allowing the cathode to sustain higher currents. This scale can also be a good match for suspending monolayer molecular membranes, e.g., graphene, hexagonal boron nitride, molybdenum di-sulfide, in environments experiencing strong electrostatic forces and dynamic collisions from electrons. Once accelerated to and through the pellicles the electrons can become a useful source of electron streams that can be injected into a variety of devices.

Modulation of the voltage on the pellicles themselves or upon the structures supporting the pellicles may adjust the electron stream both by changing the rate at which electrons are cleared from the cathode or by matching the emitted electrons to the transparency energy range(s) of the pellicle(s).

Monolayers, e.g., graphene, molybdenum disulfide, and boron nitride, can be physically strong and chemically inert. In various examples, monolayers tend not to bond with contaminants and, in the presence of a sufficiently high temperature, any contaminants should eventually evaporate. This can be useful with current dispensers, which can comprise tungsten sponges infused with barium and be heated to a point where electrons leak from the barium. Barium (Ba) is a chemical neighbor of cesium (Cs), both of which can hold their outer electrons loosely, but barium has a higher melting point. In an embodiment, light can be used to activate the surfaces of many cesium photoconductors. In another embodiment, heat may be used to activate a barium dispenser. A drawback to the use of barium, in some examples, is that it can evaporate. In some embodiments, a pellicle covering a barium current dispenser can block this evaporation, but not block the electrons, resulting in a cleaner device. In various embodiments, if the pellicle is maintained at a higher temperature than the dispenser, the barium may be recycled back to the sponge area. In another embodiment, a cesium dispenser may be similarly applied. In a further embodiment, employing a photoconductor like cesium, it can be desirable to cool the cesium surface. In some examples, gallium arsenide (GaAs) photoconductors activated with cesium can maintain performance within 5% for a thousand hours if the temperature is kept below 20 C.

Even though the pellicle may be unreactive chemically, in some cases contaminants might condense onto the pellicle. To counter this, the pellicle may operate at a raised temperature, perhaps taking advantage of ohmic heating from the current passing through it or by the application of other heat sources. The raised temperature may evaporate contaminants from the pellicle so that it remains clean.

In some embodiments, the pellicle may also work to prevent contaminants originating at the cathode from travelling to those parts of the system on the other side of the pellicle. Pellicles of materials such as graphene or planar boron-nitride can be resistant to chemical reactions and be effective barriers to contaminants.

In some embodiments, the pellicle can be part of the device that creates the electric fields that shape the electron trajectories. There can also be a selectivity effect in which electrons that pass through a pellicle may be selected or redirected towards a geometric normal direction relative to the pellicle, which also can be useful to shape the electron trajectories. A pellicle so constructed, in some examples, not only inhibits contamination but can contribute to the functionality of electron lenses by flattening the potential gradients at the opening where the electrons pass and shaping the paths of the electrons. Another useful effect can be that the pellicle can be more transparent to electrons passing through in a direction normal to the pellicle than if such electrons pass through obliquely, and thus the pellicle can select for a more perpendicular electron flow.

Cathodes isolated in this manner can have longer operational lives. For example, the pellicles may eventually accumulate sufficient contaminants to impair operation, but the pellicles can be arranged to have much broader areas and may not be as sensitive to chemical activity as the cathodes, so increased operational lifetimes of the cathodes can, in many applications become practical. Some kinds of monolayers such as hexagonal boron nitride or graphene can be chemically inert, resisting the accumulation of most contaminants.

In an embodiment, an assembly containing the one or more pellicles can be constructed separately from the cathode and then brought into contact with the cathode as part of a later assembly process or at the commencement of operation. After alignment, the electrostatic forces between the cathode and the pellicle assembly may pull them together.

Figure 6:
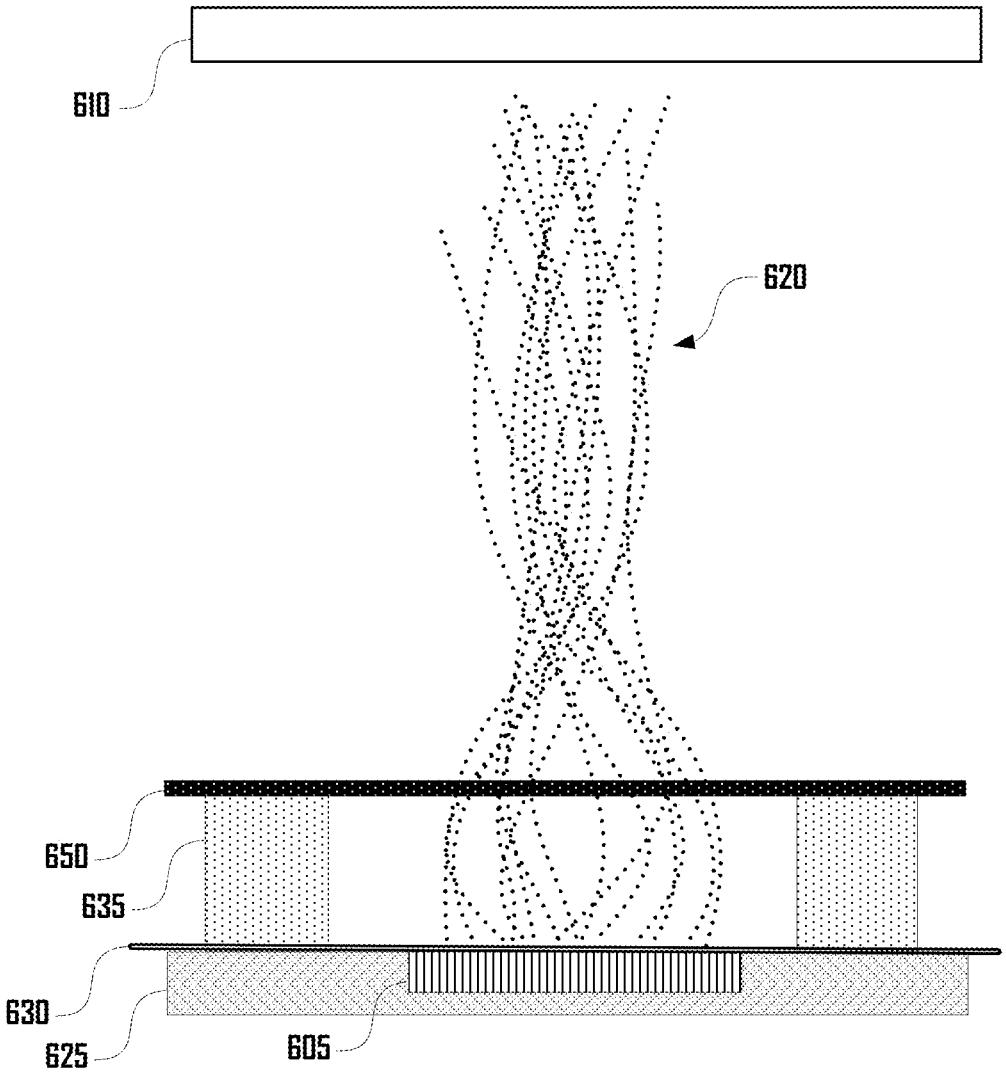
FIG. 6 is an exemplary diagram illustrating an embodiment of an electron dispenser with a contact pellicle.

FIG. 6 is an exemplary diagram illustrating an electron dispenser with a contact pellicle. A single layer of graphene 630 may be in direct contact with the cathode 605 in an embodiment as a current dispenser embedded in a support 625. Graphene can have strong physical integrity and low chemical reactivity, thus providing a physical barrier to the evaporation of material from the cathode 605 in some examples. In certain combinations, even a contaminated pellicle can permit continued electron emission, though generally at reduced efficiency. The result can be extended operation of a device in such examples. In an embodiment, an additional support structure 635 and second pellicle 650 can be introduced to shape and modulate the electron paths 620. In another embodiment, multiple sets of support structures and pellicles can be employed to incorporate electron deflection.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives.

What is claimed is:

1. A system, comprising:

a cathode;

an apparatus creating a voltage gradient that becomes more positive as distance from the cathode increases, the cathode possessing a voltage less than 100 volts;

a vacuum chamber having the cathode and the voltage gradient disposed therein, the vacuum chamber enclosing at least the cathode and the voltage gradient in a vacuum and holding the cathode and the voltage gradient in position such that the voltage gradient originates with and extends from the cathode;

an electrical circuit, the electrical circuit connected to and supplying a voltage difference between the cathode and apparatus, supporting the voltage gradient; and one or more pellicle structures, disposed within the vacuum chamber, the one or more pellicle structures disposed between the cathode and the point distant from the cathode and comprising:

a deflecting structure;

an insulating structure; and a pellicle;

wherein the deflecting structure is in contact with the cathode, the insulating structure is in contact with the deflecting structure without being in contact with the cathode, the deflecting layer coupling the insulating structure and the pellicle without being in contact with the cathode or apparatus, the pellicle being connected to the insulating structure without being in contact with the cathode or apparatus;

wherein the voltage gradient accelerates electrons emitted by the cathode toward the more positive regions of the gradient; and wherein the pellicle allows electrons to pass and blocks atomic particles larger than electrons.

2. The system of claim 1, wherein the cathode is a photo-cathode.

3. The system of claim 1, wherein the deflecting layer is electrically conducting, and a voltage at the deflecting layer is substantially the same as a voltage at the cathode.

4. The system of claim 1, wherein the cathode is an electron dispensing cathode.

5. A pellicle system for an apparatus having a voltage gradient that becomes more positive as distance from a cathode increases, comprising one or more pellicles; wherein at least one of the one or more pellicles encloses the cathode; wherein the one or more pellicles allow electrons to pass and block atoms and molecules.

6. The system of claim 5, wherein at least one of the one or more pellicles is a conductor.

7. The system of claim 5, wherein at least one of the one or more pellicles is a semiconductor.

8. The system of claim 5, wherein at least one of the one or more pellicles is an insulator.

9. The system of claim 5, wherein at least one of the one or more pellicles comprises a highly conducting sublayer and at least one of the one or more pellicles comprises a less conducting sublayer.

10. The system of claim 5, wherein at least one of the one or more pellicles comprises a semiconductor sublayer and at least one of the one or more pellicles comprises a less conducting sublayer.

11. The system of claim 5, wherein a positive voltage is established on the pellicle, the voltage being positive relative to the cathode.

12. The system of claim 5, wherein at least one of the one or more pellicles is a monolayer.

13. A method of preventing contamination relating to a cathode, comprising:

the cathode having an emitting side and a non-emitting side, placing a first pellicle in contact with the emitting side of the cathode, the first pellicle allowing electrons to pass and blocking atoms and molecules and further comprising one or more additional pellicles, the one or more additional pellicles disposed opposite the first pellicle and the emitting side of the cathode.

14. The method of claim 13, wherein the first pellicle possesses a plurality of layers, at least one layer comprising a semiconductor and at least one layer comprising an insulator.

15. The method of claim 13, wherein the first pellicle possesses a plurality of layers, at least one layer comprising a conducting material and at least one layer comprising a semiconducting material.

16. The method of claim 13, wherein the first pellicle possesses a plurality of layers, at least one layer comprising a highly conducting sublayer and at least one layer comprising a less conducting sublayer.

17. The method of claim 13, wherein the first pellicle is a monolayer.

18. The method of claim 13, further comprising providing a voltage to the first pellicle that is at least as positive as the voltage of the cathode.

19. The method of claim 13, further comprising providing a voltage to the one or more additional pellicles that is at least as positive as the voltage of the first pellicle, wherein the voltage on the one or more additional pellicles is increasingly positive with distance from the cathode.

* * * * *